United States Patent [19]

Fujimoto et al.

[11] Patent Number: 4,796,589

[45] Date of Patent: Jan. 10, 1989

[54] AIR-FUEL RATIO FEEDBACK CONTROL METHOD FOR INTERNAL COMBUSTION ENGINES

[75] Inventors: Sachito Fujimoto; Kazunari Yamashita, both of Wako, Japan

[73] Assignee: Honda Giken Kogyo K.K. (Honda Motor Co., Ltd. In English), Tokyo, Japan

[21] Appl. No.: 148,486

[22] Filed: Jan. 26, 1988

[30] Foreign Application Priority Data

Mar. 31, 1987 [JP] Japan ..... 62-78336

[51] Int. Cl.[4] ..... F02M 23/08; F02B 3/00

[52] U.S. Cl. ..... 123/489; 123/440

[58] Field of Search ..... 123/489, 488, 440, 486, 123/478, 436, 492, 480

[56] References Cited

U.S. PATENT DOCUMENTS 4,715,344 12/1987 Tomisawa ..... 123/489

4,729,359 3/1988 Tomisawa et al. ..... 123/489

4,730,594 3/1988 Hibino et al. ..... 123/489

*Primary Examiner*—Raymond A. Nelli

*Attorney, Agent, or Firm*—Arthur L. Lessler

[57] ABSTRACT

A method of effecting feedback control of the air-fuel ratio of an air-fuel mixture being supplied to an internal combustion engine, to bring the air-fuel ratio to desired values by correcting a fuel quantity to be supplied to the engine by means of a correction coefficient which varies in response to output from an exhaust gas concentration sensor, when the engine is operating in an air-fuel ratio feedback control region. An average value of values of the correction coefficient obtained is calculated while the engine is operating in the feedback control region. The calculated average value is corrected in dependence on a temperature of the engine and the feedback control is initiated by using the corrected average value as an initial value of the correction coefficient when the engine has shifted into the feedback control region from the another region. The calculated average value is corrected to such a value as to make the air-fuel ratio leaner as the engine temperature is lower.

8 Claims, 8 Drawing Sheets

FUEL INJECTION VALVES
6
INTERNAL COMBUSTION ENGINE
1
CYL
12
Ne
11
Tw
10
THREE-WAY CATALYST
14
13
O2
15
ECU
5
18
16
17
TA
9
PBA
8
7
2
θTH
4
3
3'

| FIG. 4A | FIG. 4B |
|---|---|

AIR-FUEL RATIO FEEDBACK CONTROL METHOD FOR INTERNAL COMBUSTION ENGINES

BACKGROUND OF THE INVENTION

This invention relates to a method of feedback controlling the air-fuel ratio of an air-fuel mixture being supplied to internal combustion engine, and more particularly to a method of this kind which is applied immediately after the transition of the engine to the feedback control region from another operating region.

An air-fuel ratio feedback control method for internal combustion engines is already known, e.g. from Japanese Provisional Patent Publication (Kokai) No. 58-160528 owned by the assignee of the present application, which controls the air-fuel ratio of an air-fuel mixture being supplied to an internal combustion engine by the use of a coefficient variable in response to the output of an oxygen concentration sensor arranged in the exhaust system of the engine during operation in an air-fuel ratio feedback control region.

This known method comprises determining whether the engine is operating in the feedback control region or in an operating region other than the former region, calculating an average value of values of the coefficient obtained during the engine operation in the feedback control region, and initiating the feedback control by using the coefficient which is set to an initial value obtained by multiplying or adding the average value by or to a predetermined value when the engine has shifted to the feedback control region from the other operating region. Thus, the initial value of the coefficient is set to an appropriate value demanded by the engine at the start of the feedback control operation, e.g. to a value enriching the air-fuel ratio of the mixture to thereby reduce the amount of NOx present in exhaust gases emitted from the engine.

However, according to the above method, the predetermined value to be multiplied by or added to the average value of the coefficient is set independently of the engine temperature, e.g. the temperature of engine coolant. As a result, the method has the following disadvantage: When the engine coolant temperature is low, the fuel to be supplied to the engine has higher viscosity than when the engine coolant temperature is high. Consequently, a great amount of fuel adheres to the inner walls of the intake pipe, which fuel is supplied to the cylinders of the engine together with fuel injected by fuel injection valves to cause the air-fuel ratio to become overrich, whereby it is difficult to restrain emission of CO and HC.

SUMMARY OF THE INVENTION

It is therefore the object of the invention to provide an air-fuel ratio feedback control method for internal combustion engines, which is capable of setting the air-fuel ratio to an appropriate value in dependence on the engine temperature upon transition of the engine operation to the feedback control region from another operating region, to thereby achieve satisfactory exhaust emission characteristics both at high temperatures and at low temperatures.

To attain the above object, the present invention provides a method of effecting feedback control of the air-fuel ratio of an air-fuel mixture being supplied to an internal combustion engine having an exhaust system and an exhaust gas ingredient concentration sensor arranged in the exhaust system, to bring the air-fuel ratio to desired values by correcting a fuel quantity to be supplied to the engine by means of a correction coefficient which varies in response to output from the exhaust gas concentration sensor, when the engine is operating in an air-fuel ratio feedback control region.

The method according to the invention is characterized by comprising the following steps:

(a) determining whether the engine is operating in the feedback control region or another region other than the feedback control region;

(b) calculating an average value of values of the correction coefficient obtained while the engine is operating in the feedback control region, when it is determined that the engine is operating in the feedback control region; and (c) correcting the calculated average value in dependence on a temperature of the engine and initiating the feedback control by using the corrected average value as an initial value of the correction coefficient, when it is determined that the engine has shifted to the feedback control region from the another region.

Preferably, the average value is corrected so that the initial value of the correction coefficient makes the air-fuel ratio leaner as the temperature of the engine is lower.

Also preferably, the last-mentioned correction of the average value is effected when the engine has shifted to an idling region within the feedback control region from the another region other than the feedback control region.

The above and other objects, features, and advantages of the invention will be more apparent from the ensuing detailed description taken in conjunction with the accompanying drawings.

DETAILED DESCRIPTION

The method according to the invention will now be described in detail with reference to the drawings showing an embodiment thereof.

Figure 1:
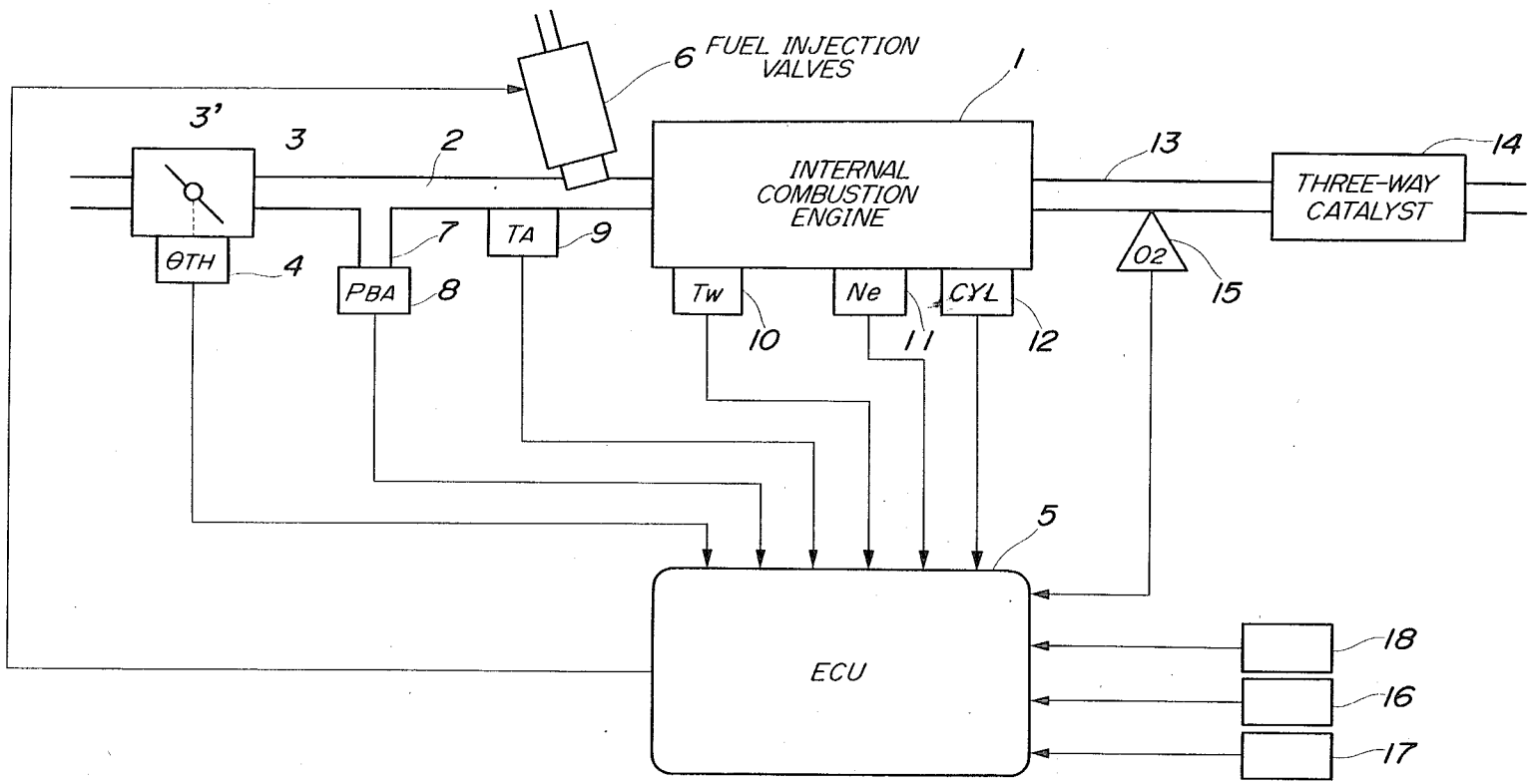
FIG. 1 is a block diagram illustrating the whole arrangement of a fuel supply control system for carrying out the method of the invention.

Referring first to FIG. 1, there is shown the whole arrangement of a fuel supply control system for an internal combustion engine, which carries out the method according to the invention. In the figure, reference numeral 1 designates an internal combustion engine for automotive vehicles. Connected to the cylinder block of the engine 1 is an intake pipe 2 across which is arranged a throttle body 3 accommodating a throttle valve 3' therein. A throttle valve opening ($\theta$th) sensor 4 is connected to the throttle valve 3' for generating an electric signal indicative of the sensed throttle valve opening and supplying same to an electronic control unit (hereinafter called "the ECU") 5.

Fuel injection valves 6, only one of which is shown, are inserted into the interior of the intake pipe 2 at locations intermediate between the cylinder block of the engine 1 and the throttle valve 3' and slightly upstream of respective intake valves, not shown. The fuel injection valves 6 are connected to a fuel pump, not shown, and electrically connected to the ECU 5 to have their valve opening periods controlled by signals therefrom.

On the other hand, an intake pipe absolute pressure (PBA) sensor 8 is provided in communication with the interior of the intake pipe 2 at a location immediately downstream of the throttle valve 3' for supplying an electric signal indicative of the sensed absolute pressure within the intake pipe 2 to the ECU 5. An intake air temperature (TA) sensor 9 is inserted into the intake pipe 2 at a location downstream of the absolute pressure sensor 8 for sypplying an electric signal indicative of the sensed intake air temperature TA to the ECU 5.

An engine coolant temperature (TW) sensor 10, which may be formed of a thermistor or the like, is mounted in the cylinder block of the engine 1, for supplying an electric signal indicative of the sensed engine coolant temperature TW to the ECU 5. An engine rotational speed (Ne) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC signal pulse whenever the crankshaft rotates through 180 degrees at predetermined crank angles, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO, and NOx. An $O_2$ sensor 15 as an exhaust gas ingredient concentration sensor is mounted in the exhaust pipe 13 at a location upstream of the three-way catalyst 14, for sensing the concentration of oxygen present in exhaust gases emitted from the engine 1 and supplying an electric signal indicative of the sensed oxygen concentration to the ECU 5.

Further electrically connected to the ECU 5 are an atmospheric pressure sensor 16, and an engine starter switch 17, for supplying electric signals respectively indicative of the sensed atmospheric pressure and the on- or off-position of the engine starter switch 17.

Also electrically connected to the ECU 5 is a battery 18 for supplying the ECU 5 with operating voltage.

The ECU 5 operates in response to the above-mentioned signals from the sensors to determine operating conditions in which the engine is operating such as an air-fuel ratio feedback control region and a fuel cut-effecting region, and calculates, based upon the determined operating regions, the valve opening period or fuel injection period TOUT over which the fuel injection valves 6 are to be opened, by the use of the following equation in synchronism with inputting of TDC signal pulses to the ECU 5:

$$T_{OUT}=T_i\times(K_{TA}\times K_{TW}\times K_{WOT}\times K_{LS}\times K_{DR}\times K_{CAT}\times K_{AST}\times X\ K_{PRO}\times K_{O2})+(Tv+\Delta Tv) \quad (1)$$

where $T_i$ represents a basic value of the fuel injection period of the fuel injection valves 6, which is determined based upon the engine rotational speed Ne and the intake pipe absoulte pressure PBA, KTA an intake air temperature-dependent correction coefficient, and $K_{TW}$ an engine coolant temperature-dependent correction coefficient, whose values are determined based upon the intake air temperature TA and the engine coolant temperature TW, respectively. $K_{WOT}$ represents an enriching coefficient for enriching the mixture at wide-open-throttle (WOT), $K_{LS}$ a leaning coefficient for leaning the mixture, and $K_{DR}$ an enriching coefficient applied for the purpose of improving the driveability of the engine 1 when the engine is operating in a predetermined low-speed open-loop control region which is passed by the engine at sudden acceleration from an idling region. $K_{CAT}$ represents an enriching coefficient applied for the purpose of preventing burning of the three-way catalyst 14 appearing in FIG. 1 when the engine 1 is operating in a predetermined high-speed open-loop control region, whose value is set to increase as load on the engine becomes larger.

$K_{AST}$ is an after-start fuel increasing coefficient applied for the purpose of preventing engine stall immediately after the engine starts.

$K_{PRO}$ is a correction coefficient applied in several particular operating conditions of the engine, details of which will be described hereinafter.

Figure 4A:
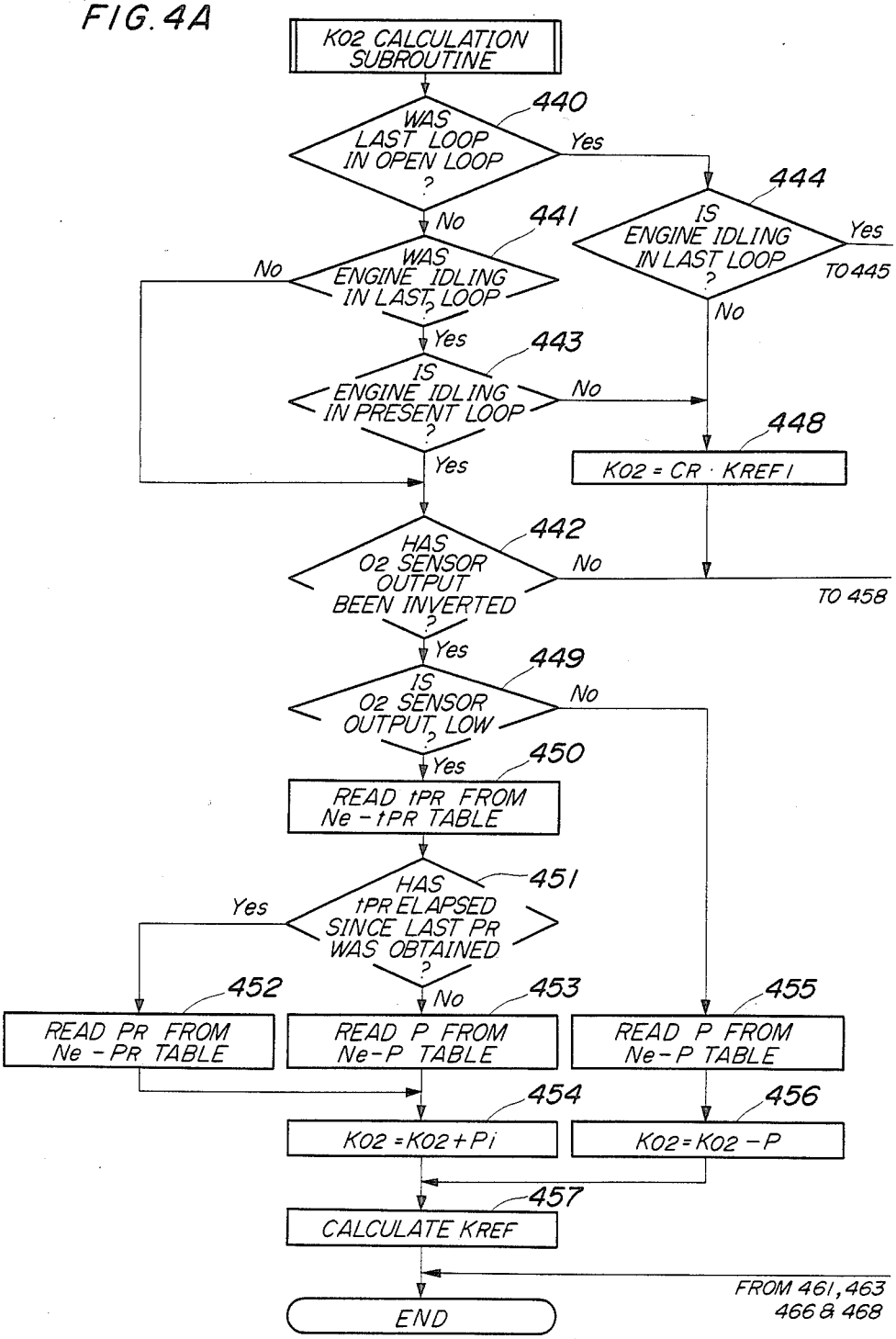
FIG. 4 is a flowchart of a subroutine for calculating the value of a coefficient $KO_2$, as a part of the program of FIG. 3.
Figures 4, 4B:
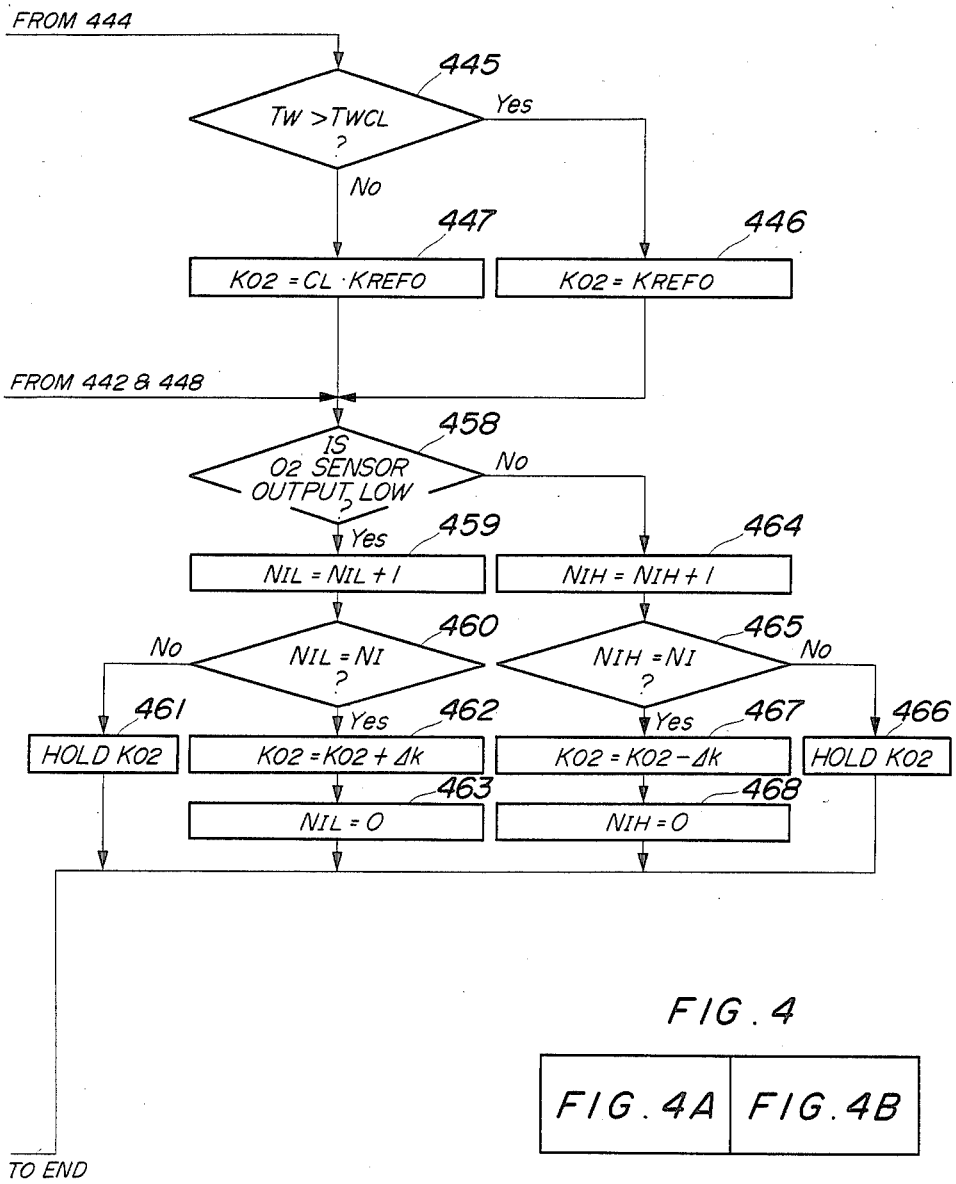

$K_{O2}$ is a feedback control correction coefficient whose value is determined in response to the oxygen concentration in the exhaust gases by means of a program shown in FIG. 4, during feedback control, while it is set to respective predetermined values while the engine is in any of other predetermined operating regions other than the feedback control regions.

Tv and Tv are correction variables dependent upon operating voltage from the battery.

The ECU 5 supplies the fuel injection valves 6 with driving signals corresponding to the calculated fuel injection period $T_{OUT}$ determined as above, over which the fuel injection valves 6 are opened.

Figure 2:
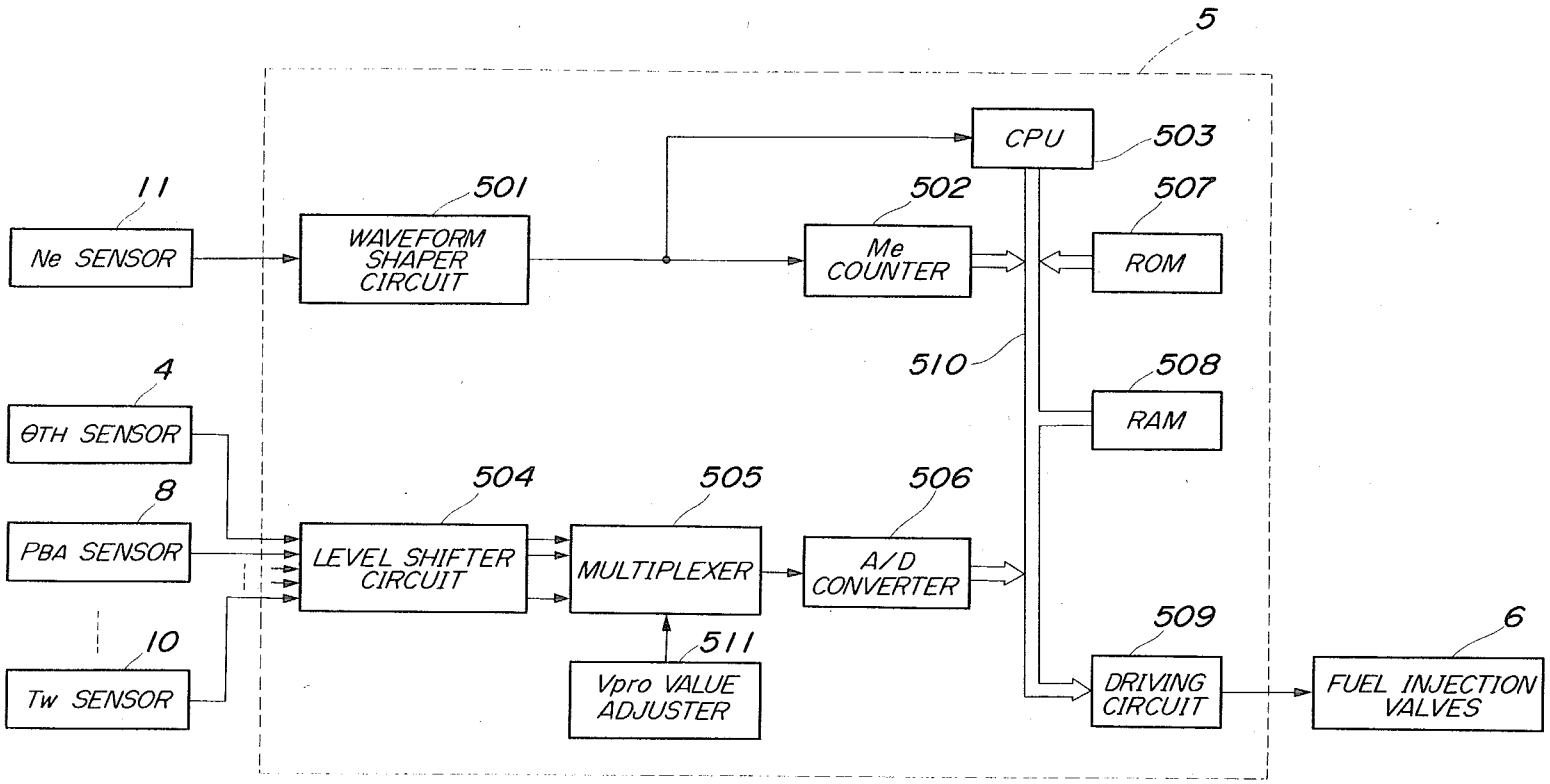
FIG. 2 is a block diagram illustrating the interior construction of an electronic control unit appearing in FIG. 1.

FIG. 2 shows the interior arrangement of the ECU 5 in FIG. 1. An output signal from the engine rotational speed sensor 501 has its waveform shaped by a waveform shaper circuit 501, and the shaped signal is supplied as TDC signal pulses to a central processing unit (hereinafter called "the CPU") 503, and also supplied to an Me counter 502. The Me counter 502 counts the time interval between inputting of an immediately preceding pulse of the TDC signal and a present pulse of same, and its counted value Me is therefore proportional to the reciprocal of the engine rotational speed Ne. The Me counter 502 supplies the counted value Me to the CPU 503 via a data bus 510.

Output signals from the throttle valve opening sensor 4, the intake pipe absolute pressure sensor 8, the engine coolant temperature sensor 10, etc. are shifted in level to a predetermined level by a level-shifter circuit 504 and the level-shbifted signals are successively delivered by a multiplexer 505 to an A/D converter 506.

A $V_{PRO}$ value adjuster 511 is connected to the multiplxer 505. The $V_{PRO}$ value adjuster 511 may be formed by a variable voltage generator circuit composed of voltage-dividing resistances connected to a constant voltage-regulator circuit and supplies the A/D converter 506 through the multiplexer 505 with a voltage $V_{PRO}$ which determines the value of the correction coefficient $K_{PRO}$ applied in particular operating regions of the engine 1, hereinafter described. The A/D converter 506 successively converts output voltages from the aforementioned various sensors and the $V_{PRO}$ value adjuster 511 into corresponding digital signals, and deliver them to the CPU 503 via the data bus 510.

Further connected to the CPU 503 via the data bus 510 are a read-only memory (ROM) 507, a random access memory (RAM) 508, and a driving circuit 509. The RAM 508 temporarily stores results of calculations executed by the CPU 503, and the ROM 507 stores a control program executed by the CPU 503, a Ti map for determining the basic fuel injection period Ti for the fuel injections valves 6 on the basis of engine rotational speed Ne and intake pipe absolute pressure PBA, maps for determining correction coefficients, etc.

The CPU 503 executes the control program stored in the ROM 507 to calculate the fuel injection period $T_{OUT}$ for the fuel injection valves 6 in accordance with the various engine operating parameter signals, and delivers control signals corresponding to the calculated $T_{OUT}$ value to the driving circuit 509, which is in turn responsive to the control signals to deliver corresponding driving signals to the fuel injection valves 6 to open same.

Figure 3:
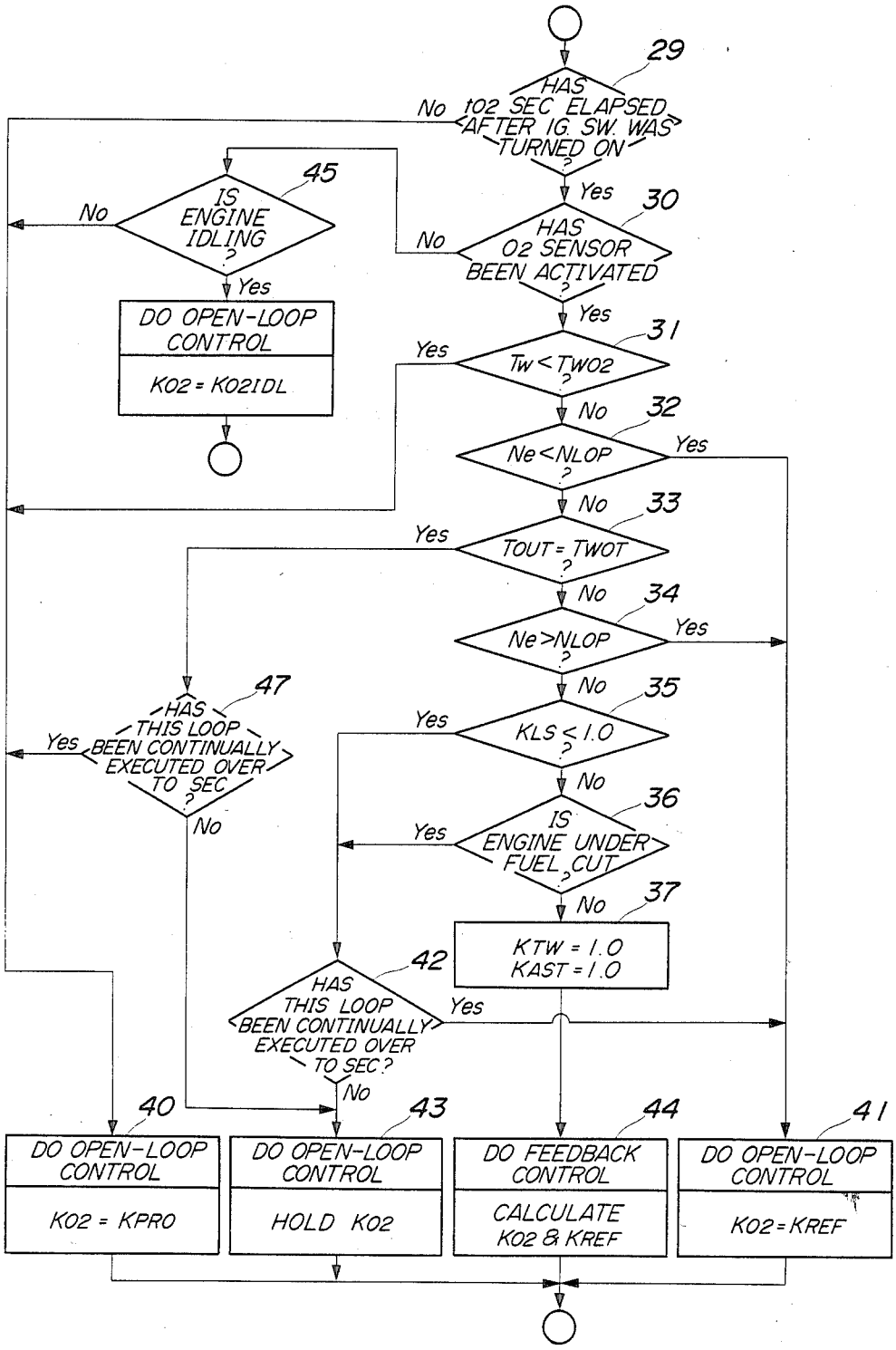
FIG. 3 is a flowchart of a program for carrying out the method of the invention.

FIG. 3 shows a control program for carrying out the method of the invention. This program is executed whenever each pulse of the TDC signal is inputted to the ECU 5.

First, it is determined at a step 29 whether or not a predetermined period of time to2 (e.g. 10 sec) has elapsed from the time the ignition switch of the engine 1 has been turned on. If the answer is No, the feedback control correction ocefficient $K_{O2}$ is set to a value of the coefficient $K_{PRO}$, hereinafter referred to, to thereby carry out open-loop control of the air-fuel ratio, at a step 40. If the answer to the question of the step 29 is Yes, it is determined at a step 30 whether or not the $O_2$ sensor 15 has become activated. If the answer is No, that is, if the $O_2$ sensor 15 has not been activated, it is determined at a step 45 whether or not the engine is operating in in idling region.

Figure 5:
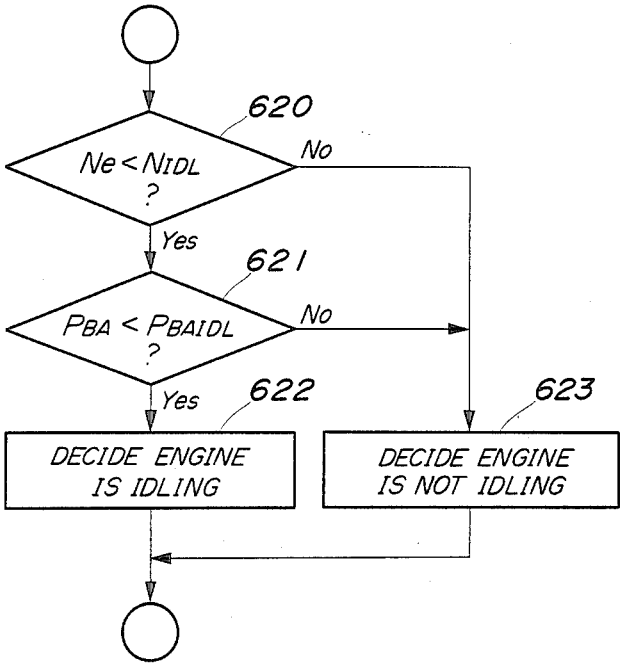
FIG. 5 is a flowchart of a subroutine for determining an idling region in which the feedback control is to be carried out, as a part of the program of FIG. 4.

The determination as to whether or not the engine is operating in the idling region is carried out in a manner shown in FIG. 5, for example. In FIG. 5, it is determined at a step 620 whether or not the engine rotational speed Ne is lower than a predetermining idling speed $N_{IDL}$ (e.g. 1000 rpm). If the answer is Yes, it is then determined at a step 621 whether or not the intake pipe absolute pressure PBA is lower than a predetermined value $PBA_{IDL}$ assumed when the engine is operating in the idling region. If the pressure PBA is lower than the predetermined value $PBA_{IDL}$, it is decided at a step 622 that the engine is operating in the idling region (a region VI in FIG. 6). If the answer to the question of the step 620 is No or if the answer to the question of the step 621 is No, it is decided at a step 623 that the engine is operating in a region other than the idling region. The above-described determination as to whether the engine is operating in the idling region may be also employed in executing a program shown in FIG. 4, hereinafter described.

Referring again to FIG. 3, when the answer to the question of the step 45 is No, the correction coefficient $K_{O2}$ is set to the value of the coefficient $K_{PRO}$ at a step 40. This coefficient $K_{PRO}$ is applied in several particular operating regions of the engine other than the feedback control region, e.g. an $O_2$ sensor-deactivated region, a low coolant temperature region, a predetermined high engine speed region, singly or together with other correction coefficients exclusively provided for the respective particular operating regions. In these particular operating regions, the value $K_{PRO}$ is set to 1.0 or a value close thereto so as to achieve air-fuel ratios best suited for the operating regions.

The above-mentioned particular operating regions are considerably different in operating condition from the feedback control regions in which an average value $K_{REF}$ is obtained from values of the correction coefficient $KO_2$ applied there. Therefore, if the average value $K_{REF}$ is directly applied in these particular operating regions, the resulting air-fuel ratios can largely be deviated from respective required values for the particular operating regions.

The coefficient $K_{PRO}$ is therefore applied in the particular operating regions, in place of the average value $K_{REF}$. The coefficient $K_{PRO}$ is set by first determining a $K_{PRO}$ value appropriate to each of engines on a production lot and which that can attain an air-fuel ratio at which optimal characteristics of the engine can be achieved such as driveability, exhaust emission, and fuel consumption, and then adjusting the output voltage $V_{PRO}$ of the $V_{PRO}$ value adjuster 511 in FIG. 2 by selecting the resistance value of the adjuster, to a value corresponding to the determined $K_{PRO}$ value.

The $K_{PRO}$ value determined as above is also stored in the ROM 507 for use as an initial value of the average value $K_{REF}$ of the coefficient $K_{O2}$ at the time of incorporating the fuel supply control system into the engine, since no average value $K_{REF}$, which is obtained from $K_{O2}$ values applied in the past engine operation, is available to the delivery of the engine.

Referring again to FIG. 3, if the answer to the question of the step 45 is Yes, that is, if the engine is operating in the idling region VI, the correction coefficient $K_{O2}$ is set to a value $K_{O2IDL}$ at a step 46 to thereby carry out open-loop control of the air-fuel ratio. This value $K_{O2IDL}$ has a value slightly larger than 1.0 so as to make the air-fuel ratio richer than the stoichiometric ratio.

If the answer to the question of the step 30 is Yes, that is, if the $O_2$ sensor 15 has become completely activated, it is determined at a step 31 whether or not the engine coolant temperature TW is lower than a predetermined value $TW_{O2}$ (e.g. 40° C.) in order to judge whether the feedback control based upon the output of the $O_2$ sensor 15 can be effected. If the answer to the question of the step 31 is Yes, the program proceeds to the aforementioned step 40, while if the answer is No, the program proceeds to a step 32. In the step 32, a determination is made as to whether or not the engine is operating in a predetermined low engine speed region, i.e. a region I in FIG. 6, by determining whether the engine rotational speed Ne is lower than a predetermined value $N_{LOP}$. If the engine is operating in the region I, a step 41 is executed to set the correction coefficient $K_{O2}$ to the average value $K_{REF}$ which has been obtained from values of the coefficient $K_{O2}$ applied in the past feedback operation.

Figure 6:
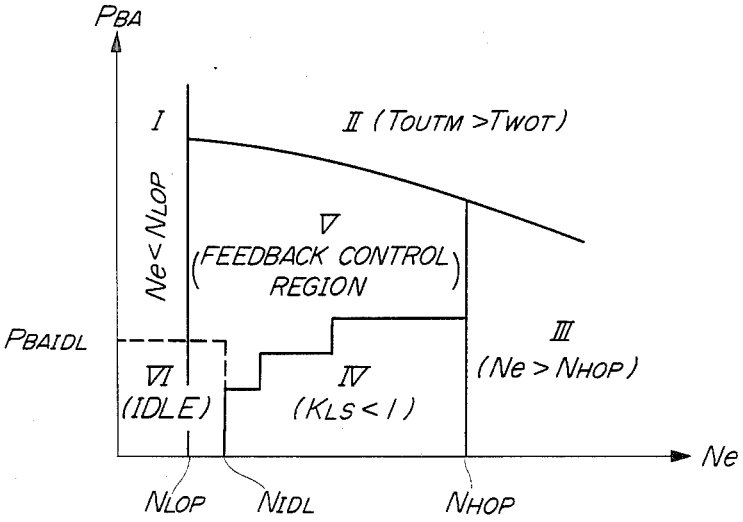
FIG. 6 is a graph showing divided operating regions of the engine.

If the answer to the question of the step 32 is No, a step 33 is executed to determine whether or not the fuel injection period $T_{OUT}$ is longer than a predetermined value $T_{WOT}$, that is, whether or not the engine is operating in a wide-open-throttle region, i.e. a region in FIG. 6. If the answer to the question of the step 33 is Yes, the program proceeds to a step 47, hereinafter referred to, whereas if the answer is No, the program proceeds to a step 34 to determine whether or not the engine is operating in a predetermined high engine speed region, i.e. a region III in FIG. 6 where the engine rotational speed Ne is higher than a predetermined value $N_{HOP}$. If the answer to the question of step 34 is Yes, the program proceeds to the aforementioned step 41, whereas if the answer is No, the program proceeds to a step 35 to determine whether or not the engine is operating in a mixture-leaning region ($KLS<1.0$) which is determined by the engine rotational speed Ne and the intake pipe absolute pressure PBA, i.e. a region IV in FIG. 6.

If the answer to the question of the step 33 is Yes, it is determined at the step 47 whether or not the loop including the step 33 has been continually executed over a predetermined period of time $t_{O2}$. If the answer is Yes, the program proceeds to the aforementioned step 40, whereas if the answer is No, the program proceeds to a step 43 to execute open-loop control by holding the coefficient $K_{O2}$ at a value assumed immediately before leaning is effected or a value assumed immediately before fuel cut is effected.

If the answer to the question of the step 35 is Yes, it is determined at a step 42 whether or not the loop including the step 35 has been continually executed over the predetermined period of time $t_{O2}$. If the answer is No, it is determined at a step 36 whether or not the engine is under fuel cut. If the answer to the question of the step 36 is Yes, the program proceeds to the aforementioned step 42. If the answer to the question of the step 42 is Yes, the program proceeds to the aforementioned step 42, while if the answer is No, the aforementioned step 43 is executed to hold the coefficient $K_{O2}$. If the answer to the question of the step 36 is No, it is decided that the engine is operating in a feedback control region, i.e. a region V in FIG. 6. Then, the engine coolant temperature-dependent correction coefficient $K_{TW}$ and the after-start fuel increasing coefficient $K_{AST}$ are both set to 1.0 at a step 37, and a value of the coefficient $K_{O2}$ and an average value $K_{REF}$ of same are calculated while the feedback control is effected, at a step 44.

As stated above, when all the answers to the questions of the steps 32 through 36 are negative, it is decided that the engine is operating in the feedback control region. If at this time the coefficients $K_{TW}$ and $K_{AST}$ have values more than 1.0, they are set to 1.0, followed by initiating the feedback control. Thus, neither engine coolant temperature-dependent correction nor after-start fuel increasing is effected during the feedback control.

The calculation of the correction coefficient $K_{O2}$ is carried out in accordance with the program shown in FIG. 4.

First, it is determined at a step 440, whether or not open-loop control was effected in the immediately preceding loop. If the answer is No, it is determined at a step 441 whether or not the engine was operating in the idling region within the feedback control region in the immediately preceding loop. If the answer to the question of the step 441 is No, it is determined at a step 442 whether or not there has been an inversion in the output level of the 02 sensor 15.

If the answer to the question of the step 440 is Yes, that is, if open-loop control was effected in the immediately preceding loop, it is determined at a step 444 whether or not the engine is operating in the idling region in the present loop. If the answer is Yes, that is, if the engine is operating in the idling region in the present loop, it is determined at a step 445 whether or not the engine coolant temperature TW is higher than a predetermined value $TW_{CL}$ (e.g. 70° C.). If the answer is Yes, that is, $TW>TW_{CL}$ stands (the engine is not in a cold condition), the coefficient $K_{O2}$ is set to an average value KREF0 for idling region, which was calculated while the engine was in the idling region within the feedback control region, as hereinafter described, at a step 446. Then, steps 458 et seq. are executed to carry out integral control of the air-fuel ratio, as hereinafter described.

If the answer to the question of the step 445 is No, that is, if $TW \leqq TW_{CL}$ stands (the engine is in a cold condition), the coefficient $K_{O2}$ is set to a product $C_L \times K_{REF0}$ obtained by multiplying the average value $K_{REF0}$ for idling region by a predetermined leaning value $C_L$ at a step 447, followed by execution of the integral control in steps 458 et seq. The predetermined leaning value $C_L$ is set at a value smaller than 1.0 so that the coefficient $K_{O2}$ is made smaller than the average value $K_{REF0}$ assumed when the engine coolant temperature TW is not low, whereby the feedback control in the idling region within the feedback control region immediately after transition from an open-loop control region is initiated with the correction coefficient $K_{O2}$ set to such a small initial value as to lean the air-fuel ratio, thus reducing emission of CO and HC in the exhaust gases.

If the answer to the question of the step 444 is No, that is, if the engine is not operating in the idling region immediately after transition to the feedback control region, at a step 448 the correction coefficient $K_{O2}$ is set to a product $C_R \times K_{REF1}$ where $K_{REF1}$ is an average value of values of $K_{O2}$ assumed while the engine is operating in a region within the feedback control region but other than the idling region, and $C_R$ is a predetermined enriching value and set at a value larger than 1.0 so that the coefficient $K_{O2}$ is made larger than the average value $K_{REF1}$, whereby the feedback control in a region other than the idling region within the feedback control region immediately after transition from an open-loop control region is initiated with the correction coefficient $K_{O2}$ set to such a large initial value as to enrich the air-fuel ratio, thus reducing emission of NOx in the exhaust gases.

If the answer to the question of the step 441 is Yes, that is, if the engine was operating in the idling region in the immediately preceding loop, it is determined at a step 443 whether or not the engine is operating in the idling region in the present loop. If the engine is operating in the idling region, the program proceeds to the aforementioned step 442, while if not, the program proceeds to the aforementioned step 448,. That is, Also in the event that the engine has shifted from the idling region (region VI in FIG. 6) within the feedback control region to another region within the feedback control region (a region V in FIG. 6), the coefficient $K_{O2}$ is set to an initial value which is larger by the predetermined enriching value $C_R$ to thereby reduce emission of NOx, as in the event that the engine has shifted to the another region within the feedback control region from an open-loop control region.

If the answer to the question of the step 442 is Yes, that is, if the output level of the $O_2$ sensor 15 has been inverted, the feedback control is effected in proportional control mode (P-term control mode). More specifically, it is determined at a step 449 whether or not the output level of the $O_2$ sensor 15 is low. If the answer is Yes, a value of a predetermined period of time tpr corrresponding to the engine rotational speed is read from an Ne-tPR table, at a step 450. This predetermined period of time tPR is provided to maintain constant the frequency of application of a second correction value $P_R$, hereinafter referred to, throughout the entire engine rotational speed range. To this end, the time period tPR is set to smaller values as the engine rotational speed Ne becomes higher.

Then, a determination is made as to whether or not the read period of time tPR has elapsed from the time the second correction value $P_R$ was applied last time, at a step 451. If the answer is Yes, a value of the second correction value $P_R$ corresponding to the engine rotational speed Ne is read from an Ne-$P_R$ table, at a step 452, while if the answer is No, a value of a first correction value P corresponding to the engine rotational speed Ne is read from an Ne-P table, at a step 453. Values of the first correction values P within the Ne-P table are smaller than respective corresponding ones of the second correction values $P_R$ within the Ne-$P_R$ table. Then, a correction value $P_i$, i.e. the read first correction value P or the read second correction value $P_R$, is added to the correction coefficient $K_{O2}$, at a step 454. If the answer to the question of the step 449 is No, a value of the first correction value P corresponding to the engine rotational speed Ne is read from the Ne-P table, at a step 455, like the step 453, and then the read first correction value P is subtracted from the coefficient $K_{O2}$, at a step 456.

In this way, whenever the output signal of the $O_2$ sensor 15 is inverted, the first correction value P or the second correction value $P_R$ read in accordance with the engine rotational speed Ne is added to the coefficient $K_{O2}$, or the first correction value P is subtracted from the coefficient $K_{O2}$ to thereby correct the latter in the direction opposite to the direction in which the sensor output level has been inverted.

The value of the correction coefficient $K_{O2}$ thus set is substituted into an equation (2) given below to calculate an average value $K_{REF}$, at a step 457, and the calculated average value $K_{REF}$ is stored in the RAM 508. As the average value $K_{REF}$, the average value KREF0 for idling region is calculated when the engine is operating in the idling region within the feedback control region, and the average value $K_{REF1}$ when the engine is operating in another region within the feedback control region, respectively:

$$K_{REF}=K_{O2P}\times(C_{REF}/A)+K_{REF'}\times(A-C_{REF})/A \quad (2)$$

where $K_{O2P}$ represents a value of $K_{O2}$ obtained immediately before or immediately after execution of the proportional control (P-term control), A an averaging constant, $C_{REF}$ an averaging variable experimentally obtained, which is set at an appropriate value between 1 and A, and KREF' an average value of values of the coefficient $K_{O2}$ obtained so far through past operation of the engine and stored.

Since the ratio of KO2P to KREF' assumed in each execution of the P-term control depends upon the variable $C_{REF}$, it is possible to freely set the degree of precision of calculation of the average value $K_{REF}$ ($K_{REF0}$ and $K_{REF1}$) by setting the $C_{REF}$ value at a value between 1 and A that best suits the type of an air-fuel ratio feedback control system, an engine, etc. to be applied.

If the answer to the question of the step 442 is No, that is, if there has been no inversion in the output level of the $O_2$ sensor 15, the feedback control is effected in integral control mode (I-term control mode). More specifically, it is determined at a step 458 whether or not the output level of the $O_2$ sensor 15 is low. If the answer is Yes, pulses of the TDC signal are counted at a step 459, and it is determined whether or not the counted TDC signal pulse number $N_{IL}$ has reached a predetermined value $N_I$, at a step 460. If the former has not yet reached the latter, the correction coefficient $K_{O2}$ is held at an immediately preceding value at a step 461, while if the former has reached the latter, a predetermined value $\Delta k$ is added to the coefficient $K_{O2}$ at a step 462, and the counted pulse number $N_{IL}$ is reset to 0 at a step 463. In this way, whenever the counted pulse number $N_{IL}$ reaches the predetermined value $N_I$, the coefficient $K_{O2}$ is increased by the predetermined value $\Delta k$.

On the other hand, if the answer to the question of the step 458 is No, pulses of the TDC signal are counted at a step 464, followed by determining whether or not the counted number NIH has reached the predetermined value $N_I$ at a step 465. If the counted number $N_{IH}$ has not yet reached the predetermined value $N_I$, the coefficient $K_{O2}$ is held at an immediately preceding value at a step 466.

If the answer to the question of the step 465 is Yes, the predetermined value $\Delta k$ is subtracted from the coefficient $K_{O2}$ at a step 467, and the counted pulse number $N_{IH}$ is reset to 0 at a step 468. In this way, whenever the counted pulse number $N_{IH}$ reaches the predetermined value $N_I$, the coefficient $K_{O2}$ is decreased by the predetermined value $\Delta k$.

As stated above, so long as the output level of the $O_2$ sensor 15 remains at a lean level or at a rich level, the constant value $\Delta k$ is added to or subtracted from the correction coefficient $K_{O2}$ each time the predetermined number $N_I$ of TDC signal pulses are generated, to thereby correct the coefficient $K_{O2}$ in the direction opposite to the rich or lean side.

According to the invention, as described above with reference to the steps 445 through 447, when the engine operating condition has shifted from an operating region other than the feedback control region to the feedback control region, the initial value of the correction coefficient $K_{O2}$ is corrected in response to the engine temperature, by correcting the average value $K_{REF}$ of values of $K_{O2}$ obtained during past engine operation within the feedback control region, in dependence on the engine coolant temperature TW.

Figure 7:
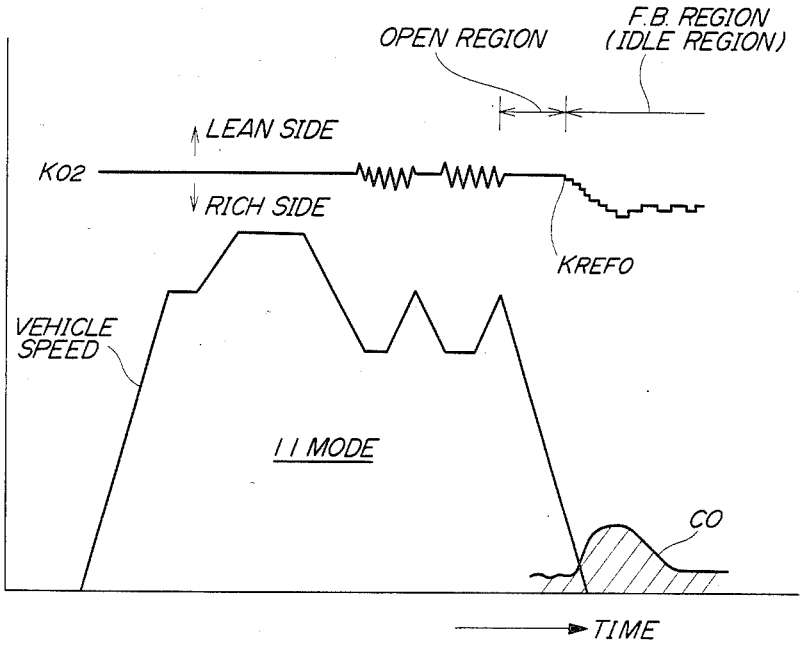
FIGS. 7*a* and 7*b* are a graph showing changes in the value of the coefficient $KO_2$ and exhaust emission characteristics of the engine obtained when the prior art method and the method of the invention are applied to a 10-Mode Test.
Figure 7:
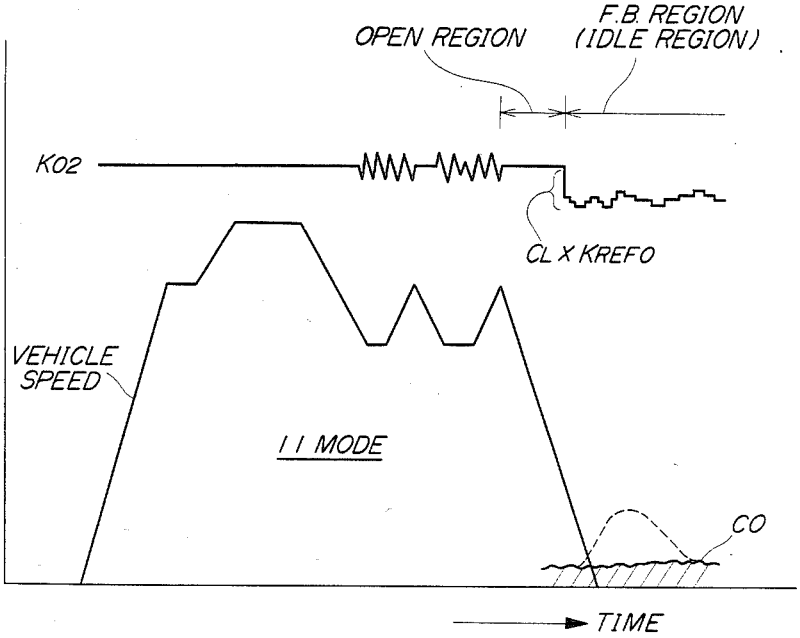
Figure 8:
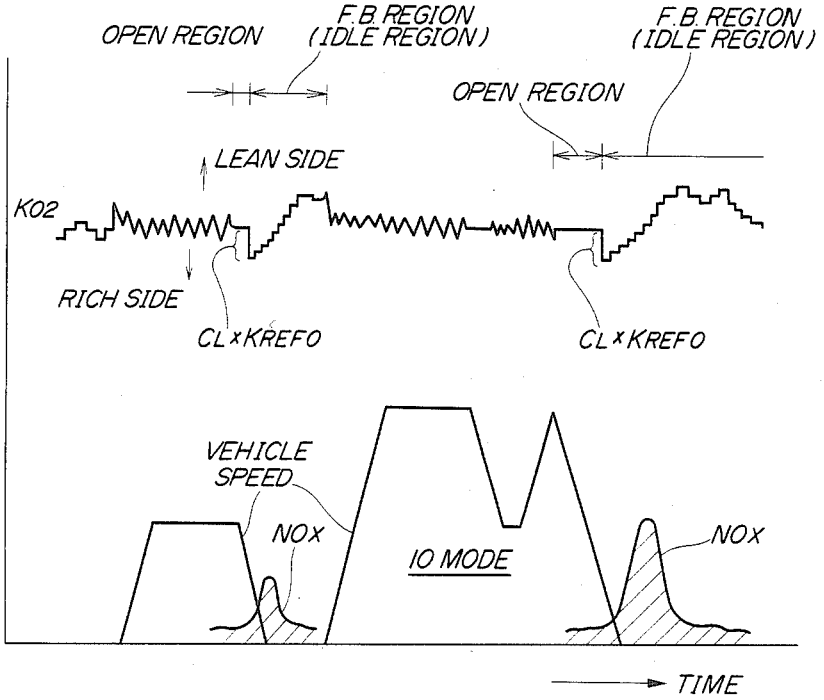
FIGS. 8*a* and 8*b* are a view similar to FIG. 7 in the case where the prior art method and the method of the invention are applied to an 11-Mode Test.
Figure 8:
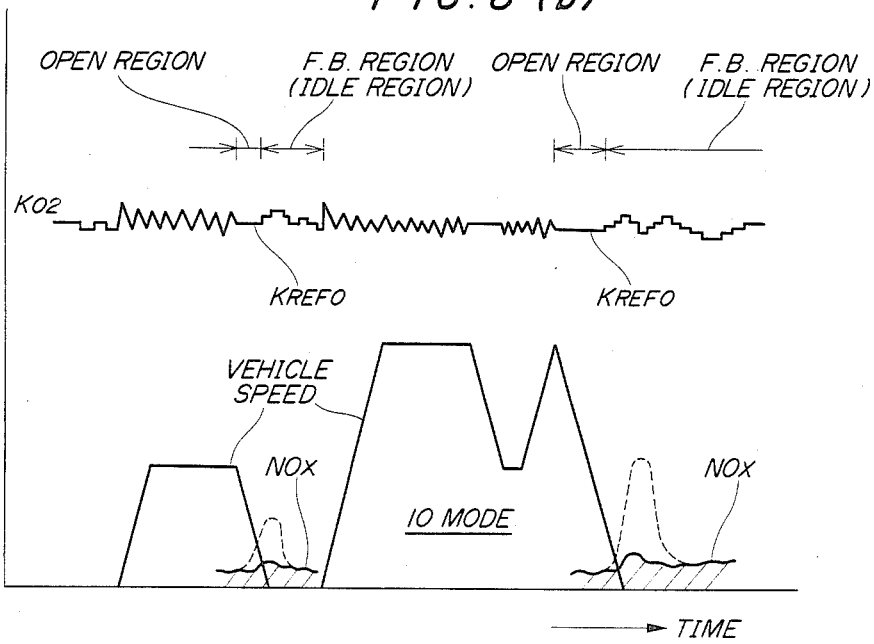

Results of exhaust emissions are shown in FIGS. 7 and 8, which have been obtained by tests on engine exhaust emission characteristics to which the prior art air-fuel ratio feedback control method and the method of the present invention have been respectively applied. FIG. 7 shows results obtained by an 11-Mode Test (Cold Start), and FIG. 8 results obtained by a 10-Mode Test (Hot Start).

As is learned from the figures, while the vehicle is decelerated to stop, the engine operating condition shifts from an open-loop control region (OPEN RE- GION) such as the mixture-leaning region IV in FIG. 6 to the idling region VI (IDLE REGION) in FIG. 6. According to the prior art method, upon this transition the initial value of the correction coefficient $K_{O2}$ is set to a value obtained by correcing the average value $K_{REF0}$ of $K_{O2}$ by a predetermined value independent of the engine coolant temperature TW. As a result, if the predetermined value is set to a value, e.g. 1.0, which conforms to an engine condition for conducting the 10-Mode Test, i.e. a warmed-up condition, there will be a delay in correcting the air-fuel ratio to the lean side when the predetermined value thus set is applied to the 11-Mode Test conducted under an warming-up condition of the engine, thus failing to reduce CO emission to a sufficient extent, as shown in (a) of FIG. 7. Conversely, if the predetermined value is set to the predetermined leaning value $C_L$ leaner than 1.0 so as to conform to the 11-Mode Test, the air-fuel ratio will be leaner when the same value $C_L$ is applied to the 10-Mode Test, thus failing to reduce NOx emission to a satisfactory extent, as shown in (a) of FIG. 8.

On the other hand, according to the present invention, in conducting the 11-Mode Test under a condition where the engine coolant temperature TW is low, the initial value of the correction coefficient $K_{O2}$ is set to the product of the average value $K_{REF0} \times$ the predetermined leaning value $C_L$. As a result, the air-fuel ratio will be promptly corrected toward the lean side, largely reducing CO emission by an amount indicated by the broken line in (b) of FIG. 7, as compared with the prior art method. Since the 11-Mode Test is conducted under a cold condition, there is almost no increase in the NOx emission. Further, according to the present invention, the predetermined leaning value $C_L$ is not applied to the 10-Mode Test which is conducted under a hot condition, but the initial value of the correction coefficient $K_{O2}$ is set to the average value $K_{REF0}$ so that the air-fuel ratio will not be leaned, thereby reducing NOx emission by an amounted indicated by the broken line in (b) of FIG. 8, as compared with the prior art method. Since the air-fuel ratio is thus prevented from becoming leaned, there will be no undershooting of the engine rotational speed.

Therefore, the method of the present invention enables engines to pass both of the 10-Mode and 11-Mode Tests. Moreover, the method of the invention also enables to pass similar exhaust gas control tests over the world including LA-4 Mode Test in the United States and ECE Mode Test in Europe.

What is claimed is:

1. A method of effecting feedback control of the air-fuel ratio of an air-fuel mixture being supplied to an internal combustion engine having an exhaust system and an exhaust gas ingredient concentration sensor arranged in said exhaust system, to bring the air-fuel ratio to desired values by correcting a fuel quantity to be supplied to said engine by means of a correction coefficient which varies in response to output from said exhaust gas concentration sensor, when said engine is operating in an air-fuel ratio feedback control region, the method comprising the steps of:

(a) determining whether said engine is operating in said feedback control region or another region other than said feedback control region;

(b) calculating an average value of values of said correction coefficient obtained while said engine is operating in said feedback control region, when it is determined that said engine is operating in said feedback control region; and (c) correcting the calculated average value in dependence on a temperature of said engine and initiating said feedback control by using the corrected average value as an initial value of said correction coefficient, when it is determined that said engine has shifted to said feedback control region from said another region.

2. A method as claimed in claim 1, wherein said average value is corrected so that said initial value of said correction coefficient makes the air-fuel ratio leaner as said temperature of said engine is lower.

3. A method as claimed in claim 1, wherein said feedback control region is an idling region of said engine.

4. A method as claimed in claim 1, wherein said step (c) comprises correcting said average value by a predetermined value dependent upon said temperature of said engine.

5. A method as claimed in claim 4, wherein said average value is multiplied by said predetermined value.

6. A method as claimed in claim 1, wherein said temperature of said engine is the temperature of engine coolant.

7. A method of effecting feedback control of the air-fuel ratio of an air-fuel mixture being supplied to an internal combustion engine having an exhaust system and an exhaust gas ingredient concentration sensor arranged in said exhaust system, to bring the air-fuel ratio to desired values by correcting a fuel quantity to be supplied to said engine by means of a correction coefficient which varies in response to output from said exhaust gas concentration sensor, when said engine is operating in an air-fuel ratio feedback control region, the method comprising the steps of:

(a) determining whether said engine is operating in an idling region within said feedback control region or a region other than said feedback control region;

(b) calculating an average value of values of said correction coefficient obtained while said engine is operating in said idling region within said feedback control region, when it is determined that said engine is operating in said idling region; and (c) correcting the calculated average value in dependence on a temperature of said engine to a value that makes the air-fuel ratio leaner as said temperature of said engine is lower and initiating said feedback control by using the corrected average value as an initial value of said correction coefficient, when it is determined that said engine has shifted to said idling region within said feedback control region from said region other than said feedback control region.

8. A method as claimed in claim 7, further including the steps of:

(d) determining whether said engine is operating in a region other than said idling region within said feedback control region or a region other than said feedback control region;

(f) calculating an average value of values of said correction coefficient obtained while said engine is operating in said region other than said idling region within said feedback control region, when it is determined that said engine is operating in said region other than said idling region within said feedback control region; and (g) correcting the average value calculated in said step (f) to a value that makes the air-fuel ratio richer and initiating said feedback control by using the corrected average value as an initial value of said correction coefficient, when it is determined in said step (d) that said engine has shifted to said region other than said idling region within said feedback control region from said region other than said feedback control region.

* * * * *